US006284450B1

(12) United States Patent
Vandenbroucke et al.

(10) Patent No.: US 6,284,450 B1
(45) Date of Patent: Sep. 4, 2001

(54) PHOTOSENSITIVE IMAGE-FORMING ELEMENT CONTAINING SILVER HALIDE CRYSTALS INTERNALLY MODIFIED WITH A METAL-HALOGEN-FLUORINE-COMPLEX

(75) Inventors: Dirk Vandenbroucke, Boechout (BE); Matthias Höhling; Ingo Reese, both of Kiel (DE)

(73) Assignee: AGFA-Gevaert, Mortsel (BE)

( * ) Notice: Subject to any disclaimer, the term of this patent is extended or adjusted under 35 U.S.C. 154(b) by 0 days.

(21) Appl. No.: 09/251,409

(22) Filed: Feb. 17, 1999

Related U.S. Application Data

(60) Provisional application No. 60/081,765, filed on Apr. 15, 1998.

(30) Foreign Application Priority Data

Mar. 25, 1998 (EP) ..... 98201009

(51) Int. Cl.[7] ..... G03C 1/09
(52) U.S. Cl. ..... 430/605
(58) Field of Search ..... 430/605

(56) References Cited

U.S. PATENT DOCUMENTS 2,566,245 8/1951 Trivelli et al. ..... 430/608
5,240,828 * 8/1993 Janusonis et al. ..... 430/605
5,474,888 12/1995 Bell ..... 430/567
5,500,335 * 3/1996 Bell ..... 430/567
5,705,324 * 1/1998 Murray ..... 430/619
5,939,249 * 8/1999 Zou ..... 430/619

FOREIGN PATENT DOCUMENTS 0 572 022 A2 12/1993 (EP) ..... G03C/3/00
0 572 022 A3 12/1993 (EP) ..... G03C/3/00

* cited by examiner

*Primary Examiner*—Hoa Van Le
(74) *Attorney, Agent, or Firm*—Breiner & Breiner

(57) ABSTRACT

A photosensitive image-forming element is provided comprising on a support at least one photosensitive layer containing silver halide crystals which are internally doped with a transition metal complex forming centers which are able to interact with photocharges, wherein said transition metal complex is represented by the general formula (1):

$$[ML_{6-n}F_n]^{m-} \quad (1)$$

as disclosed in the claims and in the description. A method for the preparation of a silver halide containing image-forming element, wherein the silver halide comprises said transition metal complex, has also been described.

8 Claims, No Drawings

PHOTOSENSITIVE IMAGE-FORMING ELEMENT CONTAINING SILVER HALIDE CRYSTALS INTERNALLY MODIFIED WITH A METAL-HALOGEN-FLUORINE-COMPLEX

This application claims benefit to Provisional Application No. 60/081,765 filed Apr. 14, 1998.

FIELD OF THE INVENTION

The present invention relates to a photosensitive silver salt emulsion and a photosensitive material containing said emulsion. More specifically the invention relates to a silver salt emulsion with improved imaging characteristics and to a method for making said emulsion.

BACKGROUND OF THE INVENTION

A silver halide material used for industrial applications requires a very high flexibility in its practical properties for use, e.g. the light temperature range for exposure, the range or development times in which an optimal image quality can be realized, etc.. On the other hand it is necessary to have the means for the production of tailor-made silver halide materials for special applications which need for instance a well-defined gradation or sensitivity, etc.. One of the means increasingly used in the art, is the introduction of a hole or electron trap in the silver halide crystal, which can be realized by doping with certain metal ligand complexes. Several types of dopants influencing the photographic activity of silver halide materials in different ways are known. The type and strength of the effect of the introduction of a dopant is always the result of the formation of ionic crystal defects in the lattice which in turn can influence the path of photocharges initiated by light absorption in the crystal. The following types of active lattice centres for interaction with photocharges can be distinguished: (i) deep and permanent electron traps, (ii) non-permanent electron traps, (iii) shallow electron traps, (iv) hole traps and (v) recombination centres. A description and definition of the centres mentioned can be found in the following references: R. S. Eachus, M. T. Olm, 'Crystal Latt. Def. and Amorph. Mat.', 18,297–31(1989); A. P. Marchetti, R. S. Eachus in 'Advanced Photochemistry', 17,145–216(1992); R. S. Eachus, in 'Phys.Latent Image Form. Halides', Proc.Int.Symp. Meeting(1983), 249–275; R. S. Eachus, M. T. Olm, Ann.Rep.Prog.Chem., Sect.C,86,3–48(1989); R. S. Eachus, M. T. Olm, J.Soc.Photogr.Sci.Technol.Japan, 54(3), 294–303 (1991). An interesting survey in relation with 'shallow electron traps' (=SET's) is given in RD36736 (November 1994).

Transition metal complexes that can be used as dopant are characterized by the positions of the LUMO and HOMO, where LUMO means 'lowest unoccupied molecular orbital' and HOMO 'highest occupied molecular orbital' (see D. F. Shriver, P. W. Atkins, C. H. Langford in 'Inorganic Chemistry', Oxford University Press(1990)-Oxford-Melbourne-Tokyo). The distance between the energy levels of LUMO and HOMO of a metal ion in a given lattice is among other things determined by the electron-withdrawing strength of the different ligands in the complex. A classification of the ligands with respect to the electron-withdrawing strength is given in the following spectrochemical series as described by Shriver, Atkins and Langford (see above mentioned reference), J. E. Huheey in 'Inorganic Chemistry: Principles of Structure and reactivity' (1972)-Harper and Row, New York, or by C. K. Joergensen in 'Absorption Spectra and Chemical Bonding in Complexes' (1962)-Pergamon Press, London. The following classification order is generally adopted for the electron-withdrawing strength of a ligand in a metal complex: $I^- < Br^- < S^{2-} < SCN^- < Cl^- < NO_3^- < F^- < OH^- < H_2O < NCS^- < CH_3CN < NH_3 < NO_2^- << CN^- < CO$.

In spite of this information about the relative strength of a certain ligand it is often difficult to choose a transition metal complex as dopant having the required sensitometric influence in order to use it for a certain application. The relation between the HOMO and LUMO energy levels of a complex in solution (the way it is normally spectrophotometrically measured) and the relative position of these levels in a solid-state situation of a silver halide crystal is not known. An additional factor of uncertainty is the process of incorporating the complex into the crystal.

Excess of halides, high temperatures or extreme pH conditions during precipitation can influence the incorporation of a metal ligand complex into silver halide crystals, this being especially a problem for the asymmetric metal ligand complexes.

In the search for better photographic results new metal complexes are continuously looked for. At this moment metal ligand complexes with at least two different ligands are preferably used in practice. If all the ligands in a metal complex are more electronegative (situated more to the right side of the spectrophotometrical series) the complex is getting more SET (shallow electron trap) characteristics; if a ligand is becoming less electronegative the trap depth of the metal complex dopant will increase thereby forming a more permanent trapping centre.

Many metal ligand complexes with two or more different ligands are used in materials presently sold in the market. 'State of the art' are metal complexes containing halogen ligands used together with another ligand being chosen with respect to the kind of trapping centre needed in the silver halide grains. 'Mixed' ligand complexes with halogen ligands as described e.g. in EP-A 0 336 426 (with CN-ligands), EP-A 0 336 427 (with NO- or NS-ligand), EP-A 0 415 480 (with oxo-coordination ligands), EP-A 0 415 481 (with CO-ligand), U.S. Pat. No. 5,360,712 (with organic ligands like azole, diazole, triazole, pyridine, pyrazine, etc.) can be used in photosensitive silver halide materials. So far the activity of the metal halogen-ligand complexes has always been attributed to the 'other' ligand as NO, NS, CO, etc.. This is also the case in U.S. Pat. No. 5,500,335 and U.S. Pat. No. 5,474,888 wherein metal complexes with F-ligands are used and wherein the activity of the electronic centres in the crystals are caused by the NO-, CN- or NS-ligand.

The metal complexes described for the first time in the present invention contain one or more F-ligands next to other halogen ligands. These mixed halogen ligand complexes give sensitometric effects that can be fully attributed to the F-ligand, which is unexpected and new in the art.

OBJECTS OF THE INVENTION

It is therefore an object of the present invention to provide a photosensitive material containing a silver salt emulsion with improved sensitometric properties, said emulsion containing at least silver halide crystals.

It is a further object of the present invention to provide a photosensitive silver-salt emulsion containing silver halide crystals including a metal-halogen-fluorine-complex (called hereinafter 'MHF'-complex) providing crystal centers able to interact with photoelectrons.

It is another object of the present invention to provide a MHF-complex that can be effectively incorporated into silver-halide crystals.

It is still another object of the present invention to provide a photosensitive image-forming element comprising a photosensitive silver salt emulsion that is thermally developable.

Moreover it is a object of the present invention to provide a method for obtaining a photosensitive element containing silver halide crystals including a MHF-complex as dopant.

Further objects and advantages of the invention will become apparent from the description hereinafter.

SUMMARY OF THE INVENTION

The above mentioned objects are realised by providing a photosensitive image-forming element comprising on at least one side of a support a photosensitive layer containing silver halide crystals that are internally doped with a new type of transition metal complex with exclusively halide ligands, more preferably a metal halogen-fluorine-complex (hereinafter called 'MHF'-complex) represented by general formula (1):

$$[ML_{6-n}F_n]^{m-} \quad (1)$$

wherein:

M represents a metal selected from the group consisting of the metals belonging both to Group 7, 8, 9 and 10 and to the Periods 4, 5 and 6 of the Periodic System of Elements, F represents the chemical element fluorine, L represents one halogen atom or a mixture of at least two different halogen atoms selected from the group consisting of Cl, Br and I, n equals a value satisfying following equation: $1 \leqq n \leqq 6$, m equals a value of 1, 2, 3 or 4.

The present invention further provides a method for obtaining a photosensitive image-forming element containing silver halide crystals into which the MHF-complex represented by formula (1) is incorporated.

Preferred embodiments of the present invention are further disclosed in the dependent claims.

DETAILED DESCRIPTION OF THE INVENTION

While the present invention will hereinafter be described in connection with preferred embodiments thereof, it will be understood that it is not intended to limit the invention to those embodiments. On the contrary, it is intended to cover all alternatives, modifications and equivalents as may be included within the spirit and scope of the invention as defined by the appending claims.

As already known in the art photosensitive silver halide emulsions can be prepared by precipitation in an aqueous dispersing medium including, at least during grain growth, a peptizer in which silver ions and halide ions are brought together. Grain structure and properties are selected by control of several parameters like precipitation temperature, pH and relative proportion of the silver and halide ions in the dispersing medium. In order to avoid fog during the precipitation the grain preparation is commonly carried out on the halide side of the equivalence point which is defined as "the point at which the silver and halide ion activity is equal". Moreover the silver halide emulsions of the present invention are prepared in the presence of compounds (generally known as dopants) which can be occluded in the crystal structure. Such a dopant is replacing an appropiate amount of silver and halide ions in the silver-halide lattice. The detection of the presence of said dopants in silver halide crystals themselves can be carried out by EPR or ENDOR techniques. The EPR technique and sample preparation has been described in U.S. Pat. No. 5,457,021 by Olm et al and by H. Vercammen, T. Ceulemans, D. Schoenmakers, P. Moens and D. Vandenbroucke in Proc. ICS&T of 49$^{th}$ Ann.Conf., p.54 (May 19–24, 1996; Minneapolis). The description of the ENDOR technique is given in the same Proc.Ann.Conf., p.56 by P. Moens, H. Vercammen, D. Vandenbroucke, F. Callens and D. Schoenmakers. These so-called dopants are modifying the crystal structure and are further influencing the properties of the crystal. Several parameters like sensitivity, gradation, pressure sensitivity, high or low intensity reciprocity failure (HIRF or LIRF), stability, dye desensitization, and several other sensitometric aspects of a photosensitive silver-halide emulsion can be modified by selection of the dopant, including its concentration, its valency and its location in the crystal in case of incorporation of the single metal ion. When coordination complexes or even oligomeric coordination complexes are used the different ligands bound at the central metal ion can be occluded in the crystal lattice too and can in this way influence the photographic properties of the silver halide material as well (see Research Disclosure No. 38957 (1996) p. 591, section I-D).

The present invention is based on the experimental data obtained with respect to the photographic effect of hexa-coordinated metal-halogen complexes which are incorporated into radiation sensitive silver halide grains which can be strongly enhanced if at least one of the halogen ligands is a fluorine atom.

Such complexes are represented by formula (1):

$$[ML_{6-n}F_n]^{m-} \quad (1)$$

wherein:

M represents a metal selected from the group consisting of the elements belonging to Group 7, 8, 9 and 10 as well as to the Periods 4, 5 and 6 of the Periodic System of Elements. (all references to groups and periods within the Periodic System of Elements are based on the format of the periodic table adopted by the American Chemical Society and published in 'Chemical and Engeneering News',Apr. 2, 1985), p.26). In accordance with the present invention the elements belonging to the Periods 5 and 6 of the aforementioned group are preferred. However most preferred in the present invention are the metals Ir, Os and Pt. These metals are often described together with many different ligands but complexes of these metals which correspond to formula (1) have never been encountered before as dopants in silver halide.

L represents one halogen atom or a mixture of different halogen atoms selected from the group consisting of Cl, Br and I. Metal complexes containing metals as described hereinbefore together with only one halogen ligand are also described in literature as silver halide dopants but always in combination with another ligand determining the main activity of the dopant. Examples are given in EP-A 0 336 426 (with CN-ligands), EP-A 0 336 427 (with NO- or NS-ligand), EP-A 0 415 480 (with oxo-coordination ligands), EP-A 0 415 481 (with CO-ligand), etc..

F represents the chemical element fluorine. In several patents fluorine-containing metal complexes are always described with another composition of ligands than the one represented by formula (1). The patents U.S. Pat. Nos. 5,474,888 and 5,500,335 describe fluorine-ligands situated in the complex together with NO, CN or NS as ligand causing the determining dopant results.

It is further important in formula (1) that n equals an integer having a value satisfying following equation: $1 \leqq n \leqq 6$, while m equals a value of 1, 2, 3 or 4.

A survey of chemical structures that can be used as MHF-complex dopant in the present invention are summarized in Table 1 to 5.

TABLE 1

Ir (IV)-complexes $[IrF.Cl_5]^{2-}$
cis-$[IrF_2.Cl_4]^{2-}$
trans-$[IrF_2.Cl_4]^{2-}$
fac-$[IrF_3.Cl_3]^{2-}$
mer-$[IrF_3.Cl_3]^{2-}$
cis-$[IrF_4.Cl_2]^{2-}$
trans-$[IrF_4.Cl2]^{2-}$
$[IrF_5.Cl]^{2-}$
$[IrF_6]^{2-}$ The synthesis of all these complexes has been described in the following literature: D. Tensfeldt, W. Preetz, Z. Naturforsch 39b, 1185–1192, (1984): "Preparation and vibrational spectra of Fluoro-Chloro-Iridates(IV) including stereoisomers"; W. Preetz, Y. Petros, Angew. Chem. 83, 1019, (1971): "Vereinfachte Darstellung der Hexafluorokomplexe von Osmiun(IV), Iridium(IV) und Platin (IV)."

TABLE 2

Os (IV)-complexes $[OsF.Cl_5]^{2-}$
cis-$[OsF_2.Cl_4]^{2-}$
trans-$[OsF_2.Cl_4]^{2-}$
fac-$[OsF_3.Cl_3]^{2-}$
mer-$[OsF_3.Cl_3]^{2-}$
cis-$[OsF_4.Cl_2]^{2-}$
trans-$[OsF_4.Cl_2]^{2-}$
$[OsF_5.Cl]^{2-}$
$[OsF_6]^{2-}$ The synthesis of all these complexes has been described in the following literature: W. Preetz, D. Ruf, D. Tensfeldt, Z. Naturforsch. 39b, 1100–1109, (1984): "Preparation and vibrational spectra of Fluoro-Chloro-Osmates(IV) including stereoisomers"; W. Preetz, Y. Petros, Angew. Chem. 83, 1019, (1971): "Vereinfachte Darstellung der Hexafluorokomplexe von Osmiun(IV), Iridium(IV) und Platin(IV)".

TABLE 3

Pt (IV)-complexes $[TPtF.Cl_5]^{2-}$
cis-$[PtF_2.Cl_4]^{2-}$
trans-$[PtF_2.Cl_4]^{2-}$
fac-$[PtF_3.Cl_3]^{2-}$
mer-$[PtF_3.Cl_3]^{2-}$
cis-$[PtF_4.Cl_2]^{2-}$
trans-$[PtF_4.Cl_2]^{2-}$
$[PtF_5.Cl]^{2-}$
$[PtF_6]^{2-}$ The synthesis of these complexes has been described in the following literature: W. Preetz, P. Erlhöfer, Z. Naturforsch. 44b, 412–418, (1989): "Preparation and vibrational spectra of Fluoro-Chloro-Platinates (IV) including stereoisomers"; W. Preetz, Y. Petros, Angew. Chem. 83, 1019, (1971): "Vereinfachte Darstellung der Hexafluorokomplexe von Osmiun(IV), Iridium(IV) und Platin(IV)".

TABLE 4

Re (IV)-complexes cis-$[ReFBrI_4]^{2-}$
fac-$[ReFBr_2I_3]^{2-}$
mer-$[ReFBr_3I_2]^{2-}$
trans-$[ReFBr_4I]^{2-}$
$[ReFBr_5]^{2-}$
trans-$[ReFCl_4I]^{2-}$
trans-$[ReFCl_4Br]^{2-}$
$[ReFCl_5]^{2-}$
cis-$[ReF_2I_4]^{2-}$
fac-$[ReF_2BrI_3]^{2-}$
all-cis-$[ReF_2Br_2I_2]^{2-}$
cis-$[ReF_2Br_2{}^tI_2]^{2-}$
mer-$[ReF_2Br_3I]^{2-}$
cis-$[ReF_2Br_4]^{2-}$
cis-$[ReF_2Cl_4]^{2-}$
fac-$[ReF_3I_3]^{2-}$
fac-$[ReF_3BrI_2]^{2-}$
fac-$[ReF_3Br_2I]^{2-}$
fac-$[ReF_3Br_3]^{2-}$
fac-$[ReF_3Cl_3]^{2-}$
$[ReF_5Br]^{2-}$
$[ReF_6]^{2-}$ The synthesis of these complexes has been described in the following literature: W. Preetz, L. Thilmann, Z. anorg. allg. Chem., 619, 403–408,(1993). "Darstellung fluorhaltiger Hexahalogenorhenate (IV)"; E. Weiss, Z. anorg. allg. Chem., 283, 376–389, (1956). "Fluorokomplexe des vierwertigen Rheniums".

TABLE 5

Ru (IV)-complexes $[RuF_6]^{2-}$

The synthesis of these complexes has been described in "H.N.v Allwörden, Dissertation, Kiel, 1986".

The doping procedure itself can be performed normally at any stage in the grain growth phase of the emulsion preparation during which the reactants for silver halide formation are added to the reaction vessel in the form of solutions of silver and halide salts. This can be carried out by using two different jet-inlets for the individual reactant solutions. The doping can also be executed during the grain growth process wherein the addition of the silver halide components are introduced as preformed silver halide nuclei or fine grains which easily dissolve in the precipitation medium. In the present invention special attention should be paid to the way in which the dopants are introduced during the grain growth process. The addition of the dopants can be carried out in different ways: directly, incorporated into one of the reactant flows for the silver halide formation or as an individual injection next to the reactants, and indirectly by addition of a dispersion of fine soluble silver halide grains or nuclei already comprising the dopant. In the present invention the solution containing the dopant(s) satisfying formula (1) is preferably introduced by making use of a third jet in addition to said two jets for the introduction of the silver salt and the halide salt solution for the formation of the silver halide grains. This third jet is introduced in a zone of the reactor where the compounds are rapidly incorporated into the growing microcrystals. The advantage of using a third jet is that a solvent which is most suitable for the stability of that compound can be used for the given dopant. Furthermore the temperature of the dopant solution can be adjusted in order to maximize the stability. The most stable conditions for the dopant solution are preferably tested by UV-VIS absorption. The third jet itself can be adjusted automatically or manually. The dopant solution can be added at a constant rate or at any rate profile as has been described e.g. in JP-A 03163438, wherein the dopant is occluded in two different concentrations in the silver halide grains of a direct positive emulsion.

The amount of dopant which can be used in the present invention is limited and situated between $10^{-10}$ and $10^{-2}$ mole per mole of silver halide but preferably between $10^{-8}$ and $10^{-4}$ mole per mole of silver halide. The concentration of dopant solution can be chosen freely but is determined by various factors like the solubility of the complex, the stability of the desired solution, etc.. The position in the silver halide crystals where the dopant is incorporated is also free to choose but depends on the trapping activity of the complex in the crystal. For several applications it can be interesting to have the dopant in a part of the grains of the emulsion and leave the other part without dopant. This can be realised by mixing a doped emulsion with an emulsion without dopant.

As already stated before, the formation of silver halide can be carried out by adding the individual reactants together. The addition itself can be performed through surface or subsurface delivery tubes by hydrostatic pressure or by an automatic delivery system for maintaining control of pH and/or pAg in the reaction vessel and of the rate of the reactant: solutions introduced therein, which method is used in a controlled double-jet precipitation procedure. Thereby the reactant solutions or dispersions can be added at a constant rate or a constantly increasing or fluctuating rate in combination with stepwise delivery procedures as desired. More details about possible ways of making a silver halide emulsion that can be principally used in practising this invention are summarized in Research Disclosure No. 38957 (1996), p. 591–639, section I-C. The photographic emulsions prepared in this way for use in the image-forming element of the present invention contain silver-halide crystals comprising chloride, bromide or iodide alone or combinations thereof. Other silver salts which can be incorporated into a limited amount in the silver halide lattice are silver phosphate, silver thiocyanate and some other silver salts including organic silver salts like silver citrate and others. The chloride and bromide salts can be combined in all ratios in order to form a silver chlorobromide salt. Iodide ions however can be coprecipitated with chloride and/or bromide ions in order to form a iodohalide with a iodide amount depending on the saturation limit of iodide in the lattice with the given halide composition; i.e. up to a maximum amount of about 40 mole % in silver iodobromide and up to at most 13 mole % in silver iodochloride both based on silver. It should be noted in the context of the present invention that the activity of the complex(es) or dopant(s) satisfying formula (1) is hardly influenced by the halide composition of the silver halide crystals used. The composition of the silver halide in the crystal volume can change in a continuous or in a discontinuous way. Emulsions containing crystals composed of various sections with different halide compositions are used for several different photographic applications. Such a structure with a difference in halide composition between the centre and the rest of the crystal (known as so-called "core-shell" emulsion) or with more than two crystal parts differing in halide composition (called a "band" emulsion) may occur. The changes in halide composition can be realized by direct precipitation or in an indirect way by conversion wherein fine silver halide grains of a certain predetermined halide composition are dissolved in the presence of the so-called host grains forming a "shell" or "band" on the given grain. The crystals formed by the methods described above have a morphology which can be tabular or non-tabular like cubic, octahedral, etc.. In tabular crystals the aspect ratio (ratio of equivalent circular diameter to thickness) of the grains can vary from low (<2) over "medium" or "intermediate" (from 2 up to 8) to "high" (>8); especially in the case of the ultra-thin tabular crystals (from 0.05 up to 0.15 $\mu$m) high aspect ratios can be realized. The major faces of the tabular grains may have a {111} or a {100}-habit, the structure of which is stable or should be stabilized (for instance by a "crystal habit modifying agent") respectively. In the class of non-tabular grains there are a lot of possible crystal habits which can be divided into the more regular shaped crystals or in crystals with a mixed crystal habit. The emulsions can include silver halide grains of any conventional shape or size. Specifically the emulsions can include coarse, medium or fine silver halide grains. The silver halide emulsions can be either monodisperse or polydisperse after precipitation. The polydispersity can be the result of mixing two or more monodispersed emulsions.

Besides the dopants represented by formula (1) other dopants can be added during the preparation of the silver halide emulsion. These are optionally introduced only if their specific influence on the photographic characteristics is desired. As stated already in the description of the background of the present invention different classes of dopants are known. It is a special feature of the present invention to use combinations of dopants including at least one satisfying formula (1). It means that together with a deep electron trapping metal complex represented by formula (1) another dopant can be present (e.g. $Ru(CN)_6^{2-}$) creating shallow electron traps in silver halide. But it is also possible that for instance $RuCl_5(NO)^{3-}$ (as deep electron trap) is used together with $PtF_6^{2-}$ as SET. At any time the specific activity of the dopants of the present invention can be clearly demonstrated by using the EPR or ENDOR techniques which are extensively described in the aforementioned references of Vercammen et al and Moens et al.. Many examples have already been described in the patent literature but cover different silver halide systems like those mentioned hereinbefore in WO 92/16876, EP-A 0 264 288 and EP-A 0 552 650.

After precipitation the emulsions can be coagulated and washed in order to remove any excess of aqueous soluble salts. These procedures are, together with different alternative methods like dia- or ultrafiltration and ion-exchange techniques, described in Research Disclosure No. 38957 (1996), section III. The silver halide emulsions of the present invention that are prepared in one of the ways described hereinbefore contain crystals having a spherical equivalent diameter (SED) of not more than 1.5 $\mu$m while the minimum spherical equivalent diameter is not less than 0.01 $\mu$m. The spherical equivalent diameter (SED) of the crystal represents the diameter of the sphere having the same volume as the average volume of the silver halide crystals of said emulsion.

The emulsions can be surface-sensitive emulsions forming latent images primarily at the surface of the silver halide grains or they can be emulsions forming their latent-image primarily in the interior of the silver halide grain. Furthermore the emulsions can be negative-working emulsions such as surface-sensitive emulsions or unfogged internal latent image-forming emulsions. However direct-positive emulsions of the unfogged latent-image-forming type which are positive-working by development in the presence of a nucleating agent, and even pre-fogged direct-positive emulsions can be used in the present invention. The silver halide emulsions can be chemically sensitized in many different ways. It can be carried out in the presence of a chalcogen as sulphur, selenium or tellurium, in the presence of a noble metal as e.g. gold or in combination with a chalcogen and noble metal. Sometimes it can be necessary to add a sulphur sensitizer in the form of a dispersion of solid particles as described in EP-A 0 752 614. Reduction sensitization is another method of sensitizing a photosensitive silver halide emulsion that can be combined with the chalcogen/noble metal sensitization if desired. Reduction sensitization should be mentioned as a way of introducing hole traps into the silver halide crystals for use in the image-forming elements according to the present invention in order to optimize the efficiency of latent image formation. It is clear that the incorporation of hole traps into silver halide can also be realized in other ways e.g. by the introduction of $Cu^{(+)}$, $Ni^{(2+)}$, etc.. Reduction sensitization can be performed by decreasing the pAg of the emulsion or by adding thereto reducing agents as e.g. tin compounds (see GB-Patent 789,823), amines, hydrazine derivatives, formamidine-sulphinic acids, silane compounds, ascorbic acid, reductic acid and the like. Care should however be taken in order to avoid generation of fog in an uncontrollable way. Certain "modifying agents" that can optimize the chemical sensitization process are often used. A complete description of all the different possibilities with respect to this subject can be found in Research Disclosure No. 38957(1996), section IV.

In a next step the silver halide emulsions used in the image-forming elements according to the present invention are spectrally sensitized with dyes from different classes which include polymethine dyes comprising cyanines, merocyanines, trin- tetra- and polynuclear cyanines and merocyanines, oxonols, hemioxonols, styryls, merostyryls, etc.. Sometimes more than one spectral sensitizer may be used in case a larger part of the spectrum should be covered. Combinations of several spectral sensitizers are sometimes used to get supersensitization, meaning that in a certain region of the spectrum the sensitization is greater than that from any concentration of one of the dyes alone or that which would result from the additive effect of the dyes. Generally supersensitization can be attained by using selected combinations of spectral sensitizing dyes and other addenda such as stabilizers, development accelerators or inhibitors, brighteners, coating aids, etc.. A good description of all the possibilities in spectral sensitization that is important with respect to this invention can be found in Research Disclosure No. 38957(1996), section V. In case desensitizers should be used, as for instance in pre-fogged direct-positive or in daylight handling materials, various chemical compounds are proposed for practical use. Principally all the compounds being used as desensitizers in silver halide materials and being for instance summarized in EP-A 0 477 436 can be used in combination with the elements of the present invention.

The photographic elements comprising said silver halide emulsions may include various compounds which should play a role of interest in the material itself or afterwards as e.g. in processing, finishing or storing the photographic material. These products can be stabilizers and anti-foggants (see RD No. 38957(1996), section VII), hardeners (RD No.38957(1996), section IIB), brighteners (RD No.38957 (1996), section VI), light absorbers and scattering materials (RD No.38957(1996), section III), coating aids (Res.Disclosure, No.38957(1996), section IXA), antistatic agents (Res.Disclosure, No.38957(1996) section IXC), matting agents (same Res.Disclosure, No. 38957(1996), section IXD) and development modifiers (same Res.Disclosure, section XVIII). The silver halide material can also contain different types of couplers that can be incorpated as described in the same Res.Disclosure, section X.

The photographic elements can be coated on a variety of supports as described in Res.Disclosure,No. 38957(1996), section XV, and the references cited therein.

According to the present invention a method is provided for obtaining a photosensitive image-forming element comprising the steps of:

precipitating of silver halide emulsion crystals in the presence of one or more transition metal complexes represented by the general formula (1), $$[ML_{6-n}F_n]^{m-} \quad (1)$$

wherein:

M represents a metal selected from the group consisting of the metals belonging both to Group 7, 8, 9 and 10 and to the Periods 4, 5 and 6 of the Periodic System of Elements, L represents one halogen atom or a mixture of at least two different halogen atoms selected from the group consisting of Cl, Br and I, n equals a value satisfying following equation: $1 \leqq n \leqq 6$, m equals a value of 1, 2, 3 or 4.

chemically ripening and/or fogging said crystals while spectral sensitizing or desensitizing said emulsion, and coating said emulsion on at least one side of a support, each step including the possibilities described hereinbefore.

The photographic elements may be exposed to actinic radiation, especially in the visible, near-ultraviolet and near-infrared region of the spectrum, in order to form a latent image (see Res.Disclosure, No.38957(1996) section XVI). For some applications the irradiation of the doped material with X-rays is also part of the present invention. The latent-image formed can be processed in many different ways in order to form a visible image as described in Res.Disclosure, No.38957(1996), section XIX. The present invention is also especially focusing on automatic processing photosensitive silver halide materials, which is advantageously used in order to get rapid and convenient processing. In order to prevent the disadvantages of automatic processing (as e.g. the formation of silver sludge) the materials of the present invention can preferably be processed as described in EP-A 0 732 619. The developer mentioned in the last reference contains a combination of hydroquinone and ascorbic acid or one of its isomers or derivatives as an auxiliary developing agent. In more general terms this has already been described for silver halide systems as those mentioned e.g. in EP-A 0 552 650 and EP-A 0 752 614, but it is recommended to apply the method and to use the various ascorbic acid analogues as described in EP-A 0 732 619.

According to the present invention a method is provided for obtaining an image, comprising the steps of:

information-wise exposing a photosensitive image-forming element, and subsequently processing said image-wise exposed photosensitive image-forming element in a developer comprising ascorbic acid or a derivative thereof.

According to the present invention the method is provided for obtaining an image including the step of processing an image-wise exposed photosensitive image-forming element in a developer comprising both hydroquinone and ascorbic acid or a derivative thereof.

Processing to form a visible dye image for colour materials means contacting the element with a colour developing agent in order to reduce developable silver halide and to oxidize the colour developing agent which in turn normally reacts with a coupler to form a dye. This application is extensively described in Res. Disclosure, No. 38957(1996), section XX.

Special attention should be paid to the photothermographic application which is also an important part of the present invention. In this type of materials a photosensitive agent is present which after exposure to UV, visible or IR light is capable of catalysing or participating in a thermographic process bringing about changes in optical density or colour. Examples of photothermographic materials are the so called "Dry Silver" photographic materials of the 3M Company, which are reviewed by D.A. Morgan in "Handbook of Imaging Science", edited by A. R. Diamond, page 43, published by Marcel Dekker in 1991.

The photo-addressable thermosensitive element comprises photosensitive silver halide, a reducing agent for silver ions and a binder. The thermosensitive element may further comprise a substantially light-insensitive organic silver salt in catalytic association with the photosensitive silver halide and in thermal working relationship with the reducing agent for silver ions. The element may comprise a layer system with the silver halide in catalytic association with the substantially light-insensitive organic silver salt ingredients, a spectral sensitiser optionally together with a supersensitiser in intimate sensitising association with the silver halide particles and the other ingredients active in the thermal development process or pre- or post-development stabilization of the element being in the same layer or in other layers with the proviso that the organic reducing agent and the toning agent, if present, are in thermal working relationship with the substantially light-insensitive organic silver salt, i.e. during the thermal development process the reducing agent and the toning agent, if present, are able to diffuse to the substantially light-insensitive organic silver salt, e.g. a silver salt of a fatty acid. It is the purpose of the present invention to provide a photo-sensitive image-forming element, wherein said element is a photo-addressable thermographic element, comprising a substantially light-insensitive organic silver salt, an organic reducing agent therefor in thermal working relationship therewith and a binder.

If the photosensitive silver halide grains described hereinbefore are employed together with a substantially light-insensitive organic silver salt it is used in a range of 0.1 to 90 mole % of substantially light-insensitive organic silver salt, preferably in the range from 0.2 to 50 mole %, more preferably from 0.5 to 35 mole % and most preferably in the range from 1 to 12 mole % of said subtantially light-insensitive organic silver. Preferred substantially light-insensitive organic silver salts are silver salts of organic carboxylic acids in particular aliphatic carboxylic acids known as fatty acids wherein the aliphatic carbon chain has preferably at least 12 C-atoms, e.g. silver laurate, silver palmitate, silver stearate, silver hydroxystearate, silver oleate and silver behenate, which silver salts are also called "silver soaps", silver dodecyl sulphonate described in U.S. Pat. No. 4,504,575 and silver di-(2-ethylhexyl)-sulfosuccinate described in EP-A 0 227 141. Modified aliphatic carboxylic acids with thioether groups as described e.g. in GB-P 1,111,492 and other organic silver salts as described in GB-P 1,439,478, e.g. silver benzoate and silver phthalazinone, may be used likewise to produce a thermally developable silver image. Further are mentioned silver imidazolates and the substantially light-insensitive inorganic or organic silver salt complexes described in U.S. Pat. No. 4,260,677.

A suspension of particles containing a substantially light-insensitive organic silver salt may be obtained by using a process comprising simultaneously metered addition of an aqueous solution or suspension of an organic carboxylic acid or its salt and an aqueous solution of a silver salt to an aqueous liquid as described in EP-A 0 754 969.

The silver halide emulsion grains described hereinbefore may be added to the photo-addressable thermally developable element in any way which places it in catalytic proximity to the substantially light-insensitive organic silver salt. Silver halide and the substantially light-insensitive organic silver salt being separately formed (i.e. ex-situ or "preformed") in a binder can be mixed prior to use to prepare a coating solution, but it is also effective to blend both of them for a long period of time which is especially important in cases where tabular silver halide grains are present so that an intimate contact with the large specific surface of said tabular grains is realized. Furthermore, it is effective to use a process which comprises adding a halogen-containing compound to the organic silver salt to partially convert the substantially light-insensitive organic silver salt into silver halide as disclosed in U.S. Pat. No. 3,457,075.

It has to be noted that a point of interest of the present invention is the presence of a dopant or a transition metal complex according to formula (1) in the organic silver salt material or even incorporated in the organic silver salt itself. As already mentioned for the silver halide crystals it can also be a combination of dopants satisfying formula (1). In the same way as described for silver halide grains this doping possibility can additionally be combined with a dopant of another group.

A particularly preferred mode of preparing the emulsion of organic silver salt and photosensitive silver halide for coating the photo-addressable thermally developable element from solvent media according to the present invention is disclosed in U.S. Pat. No. 3,839,049, but other methods such as those described in Research Disclosure, June 1978, item 17029 and U.S. Pat. No. 3,700,458 may also be used for producing the emulsion. Another particularly preferred mode of preparing the emulsion of organic silver salt and photosensitive silver halide for coating the photo-addressable thermally developable element from aqueous media according to the present invention is disclosed in WO97/48014, which discloses a production method for a photothermographic recording material comprising the steps of: (i) providing a support; (ii) coating the support with a photo-addressable thermally developable element comprising a substantially light-insensitive organic silver salt, photosensitive silver halide in catalytic association with the substantially light-insensitive organic silver salt, a reducing agent in thermal working relationship with the substantially light-insensitive organic silver salt and a binder, characterised in that the photosensitive silver halide is formed by reacting an aqueous emulsion of particles of the substantially light-insensitive organic silver salt with at least one onium salt with halide or polyhalide anion(s) and that the phozo-addressable thermally developable element is coated from an aqueous dispersion medium.

Suitable organic reducing agents for the reduction of the substantially light-insensitive organic silver salts in photo-addressable thermosensitive elements are organic compounds containing at least one active hydrogen atom linked to O, N or C, such as is the case with mono-, bis-, tris- or tetrakis-phenols, mono- or bis-naphthols, di- or polyhydroxy-nan-thalenes, di- or polyhydroxybenzenes, hydroxymonoethers such as alkoxynaphthols, e.g. 4-methoxy-1-naphthol described in U.S. Pat. No. 3,394,41; pyrazolidin-3-one type reducing agents, e.g. PHENIDONE (tradename), pyrazolin-5-ones, indan-1,3-dione derivatives, hydroxytetrone acids, hydroxytetronimides, 3-pyrazolines, pyrazolones, reducing saccharides, aminophenols e.g. METOL (tradename), p-phenylenediamines, hydroxylamine derivatives such as for example described in U.S. Pat. No. 4,082,901, reductones e.g. ascorbic acids, hydroxamic acids, hydrazine derivatives, amidoximes, n-hydroxyureas and the like; see also U.S. Pat. Nos. 3,074,809, 3,080,254, 3,094,417 and 3,887,378. Polyphenols such as the bisphenols used in the 3M Dry Silver™ materials, sulfonamide phenols such as used in the Kodak Dacomatic™ materials, and naphthols are particularly preferred for photothermographic recording materials with photo-addressable thermally developable elements on the basis of photosensitive silver halide/organic silver salt/reducing agent. During the thermal development process the readucing agent must be present in such a way that it is able to diffuse to the photosensitive silver halide and, if present, the substantially light-insensitive organic silver salt particles so that reduction thereof can take place.

The above mentioned reducing agents, regarded as primary or main reducing agents, may be used in conjunction with so-called auxiliary reducing agents. Auxiliary reducing agents that may be used in conjunction with the above mentioned primary reducing agents are sulfonyl hydrazide reducing agents such as disclosed in U.S. Pat. No. 5,464,738, trityl hydrazides and formyl-phenyl-hydrazides such as disclosed in U.S. Pat. No. 5,496,695 and organic reducing metal salts, e.g. stannous stearate described in U.S. Pat. No. 3,460,946 and 3,547,648.

The film-forming binder for the photo-addressable thermosensitive element according to the present invention may be coatable from a solvent or aqueous dispersion medium. In case the film-forming binder for the photo-addressable thermosensitive element is coatable from a solvent dispersion medium according to the present invention, all kinds of natural, modified natural or synthetic resins or mixtures of such resins in which the organic silver salt can be dispersed homogeneously may be used; e.g. polymers derived from a,b-ethylenically unsaturated compounds such as polyvinyl chloride, after-chlorinated polyvinyl chloride, copolymers of vinyl chloride and vinylidene chloride, copolymers of vinyl chloride and vinyl acetate, polyvinyl acetate and partially hydrolyzed polyvinyl acetate, polyvinyl acetals that are made from polyvinyl alcohol as starting material in which only a part of the repeating vinyl alcohol units may have reacted with an aldehyde, preferably polyvinyl butyral, copolymers of acrylonitrile and acrylamide, polyacrylic acid esters, polymethacrylic acid esters, polystyrene and polyethylene or mixtures thereof. A particularly suitable polyvinyl butyral containing a minor amount of vinyl alcohol units is marketed by MONSANTO USA under the trade names BUTVAR™ B76 and BUTVAR™ B79 and provides a good adhesion to paper and properly subbed polyester supports. The film-forming binder for the photo-addressable thermosensitive developable element coatable from an aqueous dispersion medium according to the present invention may be all kinds of transparent or translucent water-dispersible or water soluble natural, modified natural or synthetic resins or mixtures of such resins in which the organic silver salt can be dispersed homogeneously, for example proteins such as gelatin and gelatin derivatives (e.g. phthaloyl gelatin), cellulose derivatives such as carboxymethylcellulose, polysaccharides such as dextran, starch ethers, galactomannan, polyvinyl alcohol, polyvinylpyrrolidone, acrylamide polymers, homo- or copolymerized acrylic or methacrylic acid, latexes of water dispersible polymers, with or without hydrophilic groups, or mixtures thereof. Polymers with hydrophilic functionality for forming an aqueous polymer dispersion (latex) are described in U.S. Pat. No. 5,006,451, but serve therein for forming a barrier layer preventing unwanted diffusion of vanadium pentoxide present as an antistatic agent. The binder to organic silver salt weight ratio is preferably in the range of 0.2 to 6, while the thickness of the photo-addressable thermally developable element is preferably in the range of 5 to 50 $\mu$m.

The above mentioned binders or mixtures thereof may be used in conjunction with waxes or "heat solvents", also called "thermal solvents" or "thermosolvents", improving the reaction speed of the redox-reaction at elevated temperature. By the term "heat solvent" in this invention is meant a non-hydrolyzable organic material which is in solid state in the recording layer at temperatures below 50° C. but becomes a plasticizer for the recording layer in the heated region and/or liquid solvent for at least one of the redox-reactants, e.g. the reducing agent for the organic silver salt, at a temperature above 60° C. Useful for that purpose are a polyethylene glycol having a mean molecular weight in the range of 1,500 to 20,000 described in U.S. Pat. No. 3,347,675. Further are mentioned compounds such as urea, methyl sulfonamide and ethylene carbonate being heat solvents described in U.S. Pat. No. 3,667,959, and compounds such as tetrahydro-thiophene-1,1-dioxide, methyl anisate and 1,10-decanediol being described as heat solvents in Research Disclosure, December 1976, (item 15027) pages 26–28. Still other examples of heat solvents have been described in U.S. Pat. No. 3,438,776, and 4,740,446, and in published EP-A 0 119 615 and 0 122 512 and DE-A 3 339 810.

The photo-addressable thermosensitive material comprising said substantially light-insensitive organic silver salt and said light-sensitive silver halide crystals may include various other compounds which should play a role of interest in the material itself or afterwards as e.g. in the processing, finishing or conservation stage of the material. These compounds can be 'toning agents', also stabilizers and antifoggants, surfactants (specially for coating photo-addressable thermosensitive elements from aqueous media), anti-halation dyes and other additives (like free fatty acids, antistatic agents, surface active agents, etc.) that are described in unpublished Application EP 96/203269, filed Nov. 21, 1996. The support used for the photo-addressable thermosensitive material, the function and composition of the protective and antistatic layers, the coating of the various layers of the photothermographic recording material are disclosed in the same Application EP 96/203269.

The present invention can better be appreciated by referring to the following specific examples. They are intended to be illustrative and not exhaustive, about the requirements of the invention as described hereinbefore and as summarized in the claims nailing on to the essentials of this invention. The present invention, however, is not limited thereto.

EXAMPLES

Example 1

Application of Halogen-fluor-complexes of Osmium to a Silver Chloride Emulsion For the preparation of these emulsions the following solutions were prepared:

Solution A1:

| | |
|---|---|
| gelatin | 150 g |
| demineralized water | 3000 ml |

Solution A2:

| | |
|---|---|
| $AgNO_3$ | 1500 g |
| demineralized water | 3000 ml |

Solution A3:

| | |
|---|---|
| NaCl | 515 g |
| demineralized water | 3000 ml |

Precipitation of Emulsion E1

The pH of the solutions A1 and A3 was brought to 2.80 using a sulphuric acid solution. The solutions A2 and A3 were kept at room temperature, whereas solution A1 was heated to 50° C. The pAg was set at 7.05 using a NaCl solution. Solution A2 was added to solution A1 at a constant rate during 3 minutes, while solution A3 was added at a rate in order to keep the pAg constant at a value of 7.05. Afterwards the addition rate of solution A2 was slightly raised during 3 minutes while the addition rate of solution A3 was varied in order to raise the pAg to 7.5 in 3 minutes. Solution A2 was further added at a constantly accelerating rate starting at 7.86 mmole/min until 25.5 mmole/min during 60 minutes, while solution A3 was simultaneously added at a rate in order to keep the pAg constant at 7.5.

Afterwards the emulsion was ultrafiltrated and desalted by ultrafiltration at constant pAg of 7.7. After the washing procedure 600 g of gelatin was added to the precipitate followed by the addition of water in order to make a total of 10 kg of emulsion. The pH was set to 2.8 with a sulphuric acid solution. The thus prepared silver chloride emulsion had a monodisperse grain size distribution with a mean grain size of 0.33 $\mu$m and a procentual variation coefficient of about 15% in grain size.

Precipitation of Emulsion E2–E12

An amount of emulsion E1, corresponding to 0.86 mol AgCl was taken for the precipitation of each of these emulsions. The following solutions were prepared:

Solution A4:

| | |
|---|---|
| $AgNO_3$ | 90 g |
| demineralized water | 180 ml |

Solution A5:

| | |
|---|---|
| NaCl | 32 g |
| demineralized water | 188 ml |

Emulsion E2: Comparative Emulsion

To the emulsion E1, heated at 50° C., the solution A4 was added at constant flow rate of 6.80 mmole/min during 9 minutes. The solution A5 was added at a rate in order to keep the pAg constant at the value 7.7. The thus prepared silver chloride emulsion had a monodisperse grain size distribution with a mean grain size of 0.39 $\mu$m and a procentual variation coefficient of about 14% in grain size.

Emulsion E3

The emulsion E3 was prepared in an identical way as emulsion E2, except that between seconds 72 and 306 of the precipitation of the silver halide crystals 10.06 ml of an aqueous solution containing 1.5 $10^{-4}$ mole/l of $K_2OsCl_6$ was added by using a separate jet at a constant flow rate.

Emulsion E4

The emulsion E4 was prepared in an identical way as emulsion E2, except that between seconds 72 and 306 of the precipitation of the silver halide crystals 10.06 ml of an aqueous solution containing 1.5 $10^{-4}$ mole/l of $K_2OsBr_6$ was added by using a separate jet at a constant flow.

Emulsion E5

The emulsion E5 was prepared in an identical way as emulsion E2, except that between seconds 72 and 306 of the precipitation of the silver halide crystals 10.06 ml of an aqueous solution containing 1.5 $10^{-4}$ mole/l of $K_2OsF.Cl_5$ was added by using a separate jet at a constant flow.

Emulsion E6

The emulsion E6 was prepared in an identical way as emulsion E2, except that between seconds 72 and 306 of the precipitation of the silver halide crystals 10.06 ml of an aqueous solution containing 1.5 $10^{-3}$ mole/l of $[(CH_3)_4N]_2OsF.Cl_5$ was added by using a separate jet at a constant flow.

Emulsion E7

The emulsion E7 was prepared in an identical way as emulsion E2, except that between seconds 72 and 306 of the precipitation of the silver halide crystals 10.06 ml of a solution containing 1.5 $10^{-4}$ mole/l of fac-$[n\text{-}(C_4H_9)_4N]_2OsF_3.Br_3$ in dichloromethane was added by using a separate jet at a constant flow.

Emulsion E8.

The emulsion E8 was prepared in an identical way as emulsion E2, except that between seconds 72 and 306 of the precipitation of the silver halide crystals 10.06 ml of a solution containing 1.5 $10^{-4}$ mole/l of fac-$[n\text{-}(C_4H_9)_4N]_2OsF_3.Cl_3$ in dichloromethane was added by using a separate jet at a constant flow.

Emulsions E9

The emulsion E9 was prepared in an identical way as emulsion E2, except that between seconds 72 and 306 of the precipitation of the silver halide crystals 10.06 ml of an aqueous solution containing 1.5 $10^{-3}$ mole/l of $[(CH_3)_4N]_2OsF_3Cl_3$ was added by using a separate jet at a constant flow.

Emulsions E10

The emulsion E10 was prepared in an identical way as emulsion E2, except that between seconds 72 and 306 of the precipitation of the silver halide crystals 10.06 ml of an aqueous solution containing 1.5 $10^{-3}$ mole/l of cis-$[(CH_3)_4N]_2OsF_4Cl_2$ was added by using a separate jet at a constant flow.

Emulsions E11

The emulsion E11 was prepared in an identical way as emulsion E2, except that between seconds 72 and 306 of the precipitation of the silver halide crystals 10.06 ml of an aqueous solution containing 1.5 $10^{-3}$ mole/l of $[(CH_3)_4N]_2OsF_5Cl$ was added by using a separate jet at a constant flow.

Emulsion E12

The emulsion E12 was prepared in an identical way as emulsion E2, except that between seconds 72 and 306 of the precipitation of the silver halide crystals 10.06 ml of an aqueous solution containing 1.5 $10^{-4}$ mole/l of $K_2OsF_6$ was added by using a separate jet at a constant flow rate. Emulsion specifications are summarized in Table 1.1

Chemical Sensitization

To each of the emulsions E2 to E12 225 g gelatine and an amount of water was added in order to make 1 kg of emulsion. A part of this emulsion was chemically sensitized at 50° C., pAg 7.7 and pH 5.2 during 2 hours in the presence of 3.2 $10^{-5}$ mole of sodium toluene-thiosulphonate per mole of silver, 5.1 $10^{-6}$ mole of a bis-(dimethylcarbamoyl)-sulphide compound per mole of silver and 3.36 $10^{-6}$ mole of gold trichloride per mole of silver.

TABLE 1.1

Emulsion specifications.

| Emulsion | Dopant | Concentration ($10^{-6}$ mole/mole silver) | |
|---|---|---|---|
| E2 | none | — | Comparative |
| E3 | $K_2OsCl_6$ | 1 | Comparative |
| E4 | $K_2OsBr_6$ | 1 | Comparative |
| E5 | $K_2OsFCl_5$ | 1 | Invention |
| E6 | $[(CH_3)_4N]_2OsFCl_5$ | 10 | Invention |
| E7 | fac-$[n\text{-}(C_4H_9)_4N]_2OsF_3Br_3$ | 1 | Invention |
| E8 | fac-$[n\text{-}(C_4H_9)_4N]_2OsF_3Cl_3$ | 1 | Invention |
| E9 | $[(CH_3)_4N]_2OsF_3Cl_3$ | 10 | Invention |
| E10 | cis-$[(CH_3)_4N]_2OsF_4Cl_2$ | 10 | Invention |
| E11 | $[(CH_3)_4N]_2OsF_5Cl$ | 10 | Invention |
| E12 | $K_2OsF_6$ | 1 | Invention |

Coating Procedure

The primitive and the chemically sensitized emulsions were coated on a substrated PET base at 1.85 g gelatin per $m^2$ and 25 mmole AgCl per $m^2$. An emulsion containing gelatin (1.0 g per $m^2$), a divinyl-sulphonyl-hardener and surfactants was coated on top of the emulsion layer.

Exposure and Processing

Strips with the coated emulsions were image-wise exposed through a step-wedge original using a $10^{-3}$ sec Xenon flash. The exposed photographic materials were developed in a commercial developer G101 (Trademark of AGFA) for 15 sec at 35° C. and fixed for 5 minutes in a commercial fixer G333C (Trademark of AGFA) which was 1/3 diluted with demineralized water.

Sensitometric data that were measured on the processed strips are summarized in Table 1.2. For all these samples the fog level was 0.03 to 0.05. Sensitivity was measured at a density level of 0.2 above fog and contrast was evaluated between densities 0.1 and 0.5 above fog, i.e. in the foot of the densitometric curve. The data mentioned in Table 1.2 are the relative data expressed in percentage: for the sensitivity (Rel.Sens.) the light dose necessary to get the indicated density for a doped emulsion relative to the light dose to get the same density with the non-doped (reference) emulsion. A value of 50 means a half of the sensitivity with respect to that of the reference emulsion. The experimental error is of the order of 10 to 12%. The relative contrast (Rel.Contr.) is 100 times the ratio of the contrast for the doped and the non-doped emulsion. The table gives the results of the emulsions without (−) and with (+) chemical sensitization in the column 'Chem.Sens.' Depending the ligand structure of the osmate compounds used as a dopant in these AgCl emulsions, significant influences on quantum efficiency and contrast were observed. For the primitive emulsions, a significant lowering of sensitivity and contrast was observed by doping the AgCl-emulsions with an $OsCl^{2-}{}_6$- or $OsBr^{2-}{}_6$-complex. However doping with complexes where Br (in $E_7$ compared to $E_4$) or Cl (in $E_8$ compared to $E_5$) was replaced by a F-atom gave only for the Cl-compound $E_8$ a rather small significant change in sensitivity and contrast.

TABLE 1.2

Sensitometric data for the Os-doped emulsions.

| Emulsion Nr | Chem. Sens. (+/−) | Used Dopant | Conc. ($10^{-6}$ mol/mole silver) | Rel. Sens. (0.2 + Fog) | Rel. Contr. (0.1–0.5 + Fog) | Remarks |
|---|---|---|---|---|---|---|
| E2 | − | none | — | 100 | 100 | Comparat. |
| E3 | − | $K_2OsCl_6$ | 1 | 87 | 68 | Comparat. |
| E4 | − | $K_2OsBr_6$ | 1 | 71 | 84 | Comparat. |
| E5 | − | $K_2OsFCl_5$ | 1 | 26 | 180 | Invention |
| E6 | − | $[(CH_3)_4N]_2OsFCl_5$ | 10 | <1*) | —*) | Invention |
| E7 | − | fac-$[n\text{-}(C_4H_9)_4N]_2OsF_3Br_3$ | 1 | 79 | 89 | Invention |
| E8 | − | fac-$[n\text{-}(C_4H_9)_4N]_2OsF_3Cl_3$ | 1 | 110 | 94 | Invention |
| E9 | − | $[(CH_3)_4N]_2OsF_3Cl_3$ | 10 | 69 | 89 | Invention |
| E10 | − | cis- | 10 | 87 | 96 | Invention |

TABLE 1.2-continued

Sensitometric data for the Os-doped emulsions.

| Emul-sion Nr | Chem. Sens. (+/−) | Used Dopant | Conc. ($10^{-6}$ mol/mole silver) | Rel. Sens. (0.2 + Fog) | Rel. Contr. (0.1–0.5 + Fog) | Remarks |
|---|---|---|---|---|---|---|
| | | $[(CH_3)_4N]_2OsF_4Cl_2$ | | | | |
| E11 | − | $[(CH_3)_4N]_2OsF_5Cl$ | 10 | 93 | 92 | Invention |
| E12 | − | $K_2OsF_6$ | 1 | 89 | 91 | Invention |
| E2 | + | none | — | 100 | 100 | Compara |
| E3 | + | $K_2OsCl_6$ | 1 | 65 | 133 | Comparat. |
| E4 | + | $K_2OsBr_6$ | 1 | 117 | 98 | Comparat. |
| E5 | + | $K_2OsFCl_5$ | 1 | 30 | 125 | Invention |
| E6 | + | $[(CH_3)_4N]_2OsFCl_5$ | 10 | 1 | 106 | Invention |
| E7 | + | fac-[n-$(C_4H_9)_4N]_2OsF_3Br_3$ | 1 | 98 | 89 | Invention |
| E8 | + | fac-[n-$(C_4H_9)_4N]_2OsF_3Cl_3$ | 1 | 100 | 96 | Invention |
| E9 | + | $[(CH_3)_4N]_2OsF_3Cl_3$ | 10 | 71 | 97 | Invention |
| E10 | + | cis-$[(CH_3)_4N]_2OsF_4Cl_2$ | 10 | 93 | 103 | Invention |
| E11 | + | $[(CH_3)_4N]_2OsF_5Cl$ | 10 | 98 | 103 | Invention |
| E12 | + | $K_2OsF_6$ | 1 | 78 | 106 | Invention |

*)Maximun exposure dose is too low to reach density 0.1 above fog.

Otherwise it was clear that the sensitivity of emulsions doped with fluorine-containing complexes ($E_6 \rightarrow E_9 \rightarrow E_{10} \rightarrow E_{11}$) was tending to improve with increasing number of fluorine-atoms (whereas the gradation was almost unchanged). After chemical sensitization the introduction of a F-atom in the $OsCl_6^{2-}$-complex was giving the dopant a desensitizing activity while keeping an improved gradation ($E_3 \rightarrow E_5$). A further increase of the number of F-atoms in the $OsCl_6^{2-}$-complex improved the sensitivity of the doped emulsion while keeping the gradation in the chemically sensitized emulsion almost unchanged compared to the undoped emulsion ($E_6 \rightarrow E_9 \rightarrow E_{10} \rightarrow E_{11}$).

The effect of the dopants on the reciprocity behaviour was tested on the chemically sensitized emulsions. Different film strips were exposed using a $10^{-5}$ sec. Xe-flash pulse and a 10 sec. Xe lamp exposure with equal total light energy dose. The exposed photographic materials were developed in a surface developer at room temperature for 8 minutes and fixed for 5 minutes in a commercial fixer G333C (Trademark of Agfa) which was ⅓diluted with demineralized water. The relative sensitivity is determined in a similar way as mentioned above at reference density 0.2 above fog. The high intensity reciprocity failure (HIRF) was determined as the difference in sensitivity between the $10^{-5}$ sec. and the 10 sec. exposure. The ΔHIRF is the change in reciprocity behaviour due to the dopant. A positive value indicates that the dopant enhances the high intensity reciprocity failure, whereas a negative value indicates that the dopant lowers the HIRF. These results are summarized in Table 1.3. The largest effects on reciprocity behaviour were observed for the emulsions E3, E4 and E7. It was shown that an $OsCl_6^{2-}$-dopant decreases the HIRF, whereas an $OsBr_6^{2-}$-dopant enhances the HIRF. The introduction of F-atoms in the $OsBr_6^{2-}$-complex gives a dramatic decrease in HIRF ($E_4 \rightarrow E_7$) while the incorporation of F-atoms in the $OsCl_6^{2-}$-complex was tending to increase the HIRF ($E_3 \rightarrow E_8 \rightarrow E_{12}$ and $E_9 \rightarrow E_{10} \rightarrow E_{11}$).

TABLE 1.3

Reciprocity data for the osmium doped emulsions.

| Emulsion N° | Dopant | Conc. ($10^{-6}$ mole/mol Ag) | Relative Sens. ($10^{-5}$ sec) | Relative Sens. (10 sec) | ΔHIRF | |
|---|---|---|---|---|---|---|
| E2 | none | — | 100 | 100 | 0 | Comparat. |
| E3 | $K_2OsCl_6$ | 1 | 72 | 59 | −0.11 | Comparat. |
| E4 | $K_2OsBr_6$ | 1 | 51 | 89 | 0.24 | Comparat. |
| E5 | $K_2OsFCl_5$ | 1 | 37 | — | — | Invention |
| E6 | $[(CH_3)_4N]_2OsFCl5$ | 10 | — | — | — | Invention |
| E7 | fac-[n-$(C_4H_9)_4N]_2OsF_3Br_3$ | 1 | 123 | 79 | −0.19 | Invention |
| E8 | fac-[n-$(C_4H_9)_4N]_2OsF_3Cl_3$ | 1 | 120 | 110 | −0.04 | Invention |
| E9 | $[(CH_3)_4N]_2OsF_3Cl_3$ | 10 | 87 | 93 | 0.03 | Invention |
| E10 | cis-$[(CH_3)_4N]_2OsF_4Cl_2$ | 10 | 102 | 115 | 0.05 | Invention |
| E11 | $[(CH_3)_4N]_2OsF_5Cl$ | 10 | 95 | 120 | 0.10 | Invention |
| E12 | $K_2OsF_6$ | 1 | 72 | 89 | 0.09 | Invention |

The activity of these dopants in AgCl were also tested by EPR spectroscopy. The detection of electrons trapped at shallow electron traps can be done by employing the electron paramagnetic resonance (EPR) technique. This technique is in fact the only technique—apart from derived techniques, such as electron nuclear double resonance (ENDOR)—which enables the unambiguous detection of the functionality of these shallow electron traps, as quoted also in Olm et al U.S Ser. No. 5,503,970. The shallowly trapped photoelectrons give rise to an EPR signal, which is composed of a single line, with a g value that is characteristic for the local grain composition. It is shown in R. S. Eachus, M. T. Olm, R. Janes and M. C. R. Symons, *Phys. Stat. Sol.* 152, 583 (1989), that the g value of the shallowly trapped electron in AgCl is 1.880±0.001 and for AgBr is 1.49±0.02. The g value in EPR is characteristic for each species under study, and can be calculated and measured as described in, e.g., *Electron Paramagnetic Resonance: Techniques and Applications,* by Raymond S. Alger, (1968) published by Interscience publishers, New York. The width of the line, as a function of temperature and concentration of the added dopant complex, is described by H. Vercammen, D. Schoemaker, D. Vandenbroucke, Proceedings of the 1997 *International Symposium on Silver Halide Imaging,* Victoria—BC, Canada, 1997, pp. 125. In that reference the line width of the EPR signal of shallowly trapped electrons at 20 K is quoted to be 1.0±0.1 mT for a dopant concentration of 1 ppm. This parameter (line width) can be used as a thorough check of the concentration of the dopant which is effectively built in. Furthermore only the simulation of the line shape as described in the latter reference can yield useful information about the intensity of the EPR line. The procedure followed for the identification of the dopants in this invention is nearly identical to the one proposed by M. Olm et al. (U.S. Pat. No. 5,503,970). Powders of the emulsions were prepared in the following way: the gelatine was enzymatically removed and the emulsion crystals were sedimented. The solution was decanted and the precipitates were washed. The powder was dried before EPR characterisation. These powders were sealed in a quartz tube and mounted in a cryostat in the EPR cavity. In this way the emulsion powders could be routinely measured at 2K. This low temperature is chosen to elimate other electronic or ionic events. The powders were then exposed using a 200 W XeHg lamp with a color filter (SCHOTT UV-DAD 8-1, $\lambda_{max}$=365.9 nm, max transmittance of 44.9% and HW=8.7 nm). After 1 min exposure at 2K, during which the quartz tube is rotated to ensure complete illumination, the EPR spectrum is measured. To the recorded spectra of the test and reference emulsions a gaussian line shape was fitted by a computer program to determine the intensity and line width of the signal around g=1.88 (see description in the latter reference mentioned hereinbefore). If the intensity of the line, measured in 'arbitrary units' (=a.u.) is increased by at least 20% relative to the line measured in the reference emulsion powder, then the dopant complex is a shallow electron trap. The results with the emulsions of this example are summerized in Table 1.4. For emulsion E10 the dopant was an efficient SET agent, while the intrinsic SET activity was reduced for emulsion E6 probable because of an efficient permanent electron trapping event on the dopant.

A different approach was used for the identification of deep electron traps with EPR. In contrast to the single resonance line, different spectra were recorded for different dopants. In most cases the metal ion, forming the center of a photographically relevant dopant changes valence (−1 or +1) when trapping a photoproduced electron or hole respectively.

TABLE 1.4

EPR characteristics for the osmium doped emulsions.

| Emulsion N° | Dopant | Conc. ($10^{-6}$ mole/mole silver) | g-value | Line-width (mT) | Intensity (a.u.) | |
|---|---|---|---|---|---|---|
| E2 | none | — | 1.8787 | 0.962 | 135 | Comparat. |
| E3 | $K_2OsCl_6$ | 1 | n.a. | n.a. | n.a. | Comparat. |
| E4 | $K_2OsBr_6$ | 1 | n.a. | n.a. | n.a. | Comparat. |
| E5 | $K_2OsFCl_5$ | 1 | n.a. | n.a. | n.a. | Invention |
| E6 | $[(CH_3)_4N]_2OsFCl_5$ | 10 | 1.8796 | 0.970 | 41 | Invention |
| E7 | fac-$[n\text{-}(C_4H_9)_4N]_2OsF_3Br_3$ | 1 | n.a. | n.a. | n.a. | Invention |
| E8 | fac-$[n\text{-}(C_4H_9)_4N]_2OsF_3Cl_3$ | 1 | n.a. | n.a. | n.a. | Invention |
| E9 | $[(CH_3)_4N]_2OsF_3Cl_3$ | 10 | n.a. | n.a. | n.a. | Invention |
| E10 | cis-$[(CH_3)_4N]_2OsF_4Cl_2$ | 10 | 1.8789 | 0.926 | 225 | Invention |
| E11 | $[(CH_3)_4N]_2OsF_5Cl$ | 10 | n.a. | n.a. | n.a. | Invention |
| E12 | $K_2OsF_6$ | 1 | 1.8794 | 1.001 | 140 | Invention |

n.a. = not available.

This means that from the EPR viewpoint two different things can happen: either the dopant is EPR active (i.e. paramagnetic) before or after the trapping of a photoproduced charge, or the complex remains EPR active before and after, but its EPR spectrum is changed. In this invention the first case is observed. As an example for the detection of photographically relevant dopants, the following reference is given for the detection of $Rh^{2+}$ after trapping of an electron by a $Rh^{3+}$ ion: H. Vercammen, T. Ceulemans, D. Schoemaker, P. Moens, D. Vandenbroucke, *Proceedings of the 49th IS&T Annual Conference,* Minneaplis, Minn., 1996, pp.54. For the emulsion E6 with $[OsFCl_5]^{2-}$ dopant a clear EPR spectrum was observed before illumination at 2K. From the careful EPR analysis the following EPR Spin Hamiltonian parameters, summarized in Table 1.5, were obtained.

TABLE 1.5

EPR characteristics and experimental Spin Hamiltonian parameters for emulsion E6.

| Complex | g tensor | | | $^{189}$Os hf tensor | | $^{19}$F shf tensor | | crystal system | Reference |
|---|---|---|---|---|---|---|---|---|---|
| | $g_{\parallel}$ | $g_{\perp}$ | $g_{av}$ | $A_{\parallel}$ | $A_{\perp}$ | $A_{\parallel}$ | $A_{\perp}$ | | |
| $OsCl_5F^{3-}$ | −2.615 | −1.448 | 1.836 | — | −296 | −240 | — | AgCl (1 ppm) | this work |
| $OsCl_6^{3-}$ (C') | −1.9132 | −1.8064 | 1.842 | −315 | −294 | n/a | n/a | AgCl (Bridg) | *) |

*) taken from reference: R. S. Eachus, M. T. Olm, Rad. Eff. 73, 69 (1983)

This analysis proved the presence of the osmium core (through the detection of the characteristic osmium superhyperfine interaction and isotope distribution) and the presence of one fluorine ligand, probably located along the z axis of the complex. No evidence of ligands other then chlorine or fluorine with this method was found. Application of molecular orbital theory, also cited in R. S. Eachus, M. T. Olm, *Rad. Eff.* 73, 69 (1983) and comparison of the average g-values with other $Os^{3+}$ complexes (one is shown in the table) shows clearly that the central valence of the Os core is 3+. After the illumination procedure described above, the $Os^{3+}$-signal was found to reduce to about 20%–70% of the original intensity depending on the temperature of illumination. This can be ascribed to the capture of a photogenerated charge (in this case an electron) which reduces $OS^{3+}$ to $Os^{2+}$, which is not detectable by EPR, i.e., is not paramangetic. Indeed no extra EPR lines were detected after illumination.

Emulsion E6 was further characterized using ENDOR techniques. With X-band ENDOR and Triple ENDOR it is possible to prove that, for the osmium related complex, one of the surrounding nuclei is fluor ($^{19}$F). The EPR signal at g=1.448 (the g component of the $[OsFCl_5]^{3-}$ defect in AgCl) was saturated by using a microwave power of 100 mW at 8K. At these conditions the change of the EPR signal is recorded in function of the used radio-frequency (RF) (RF power of 100 W and a modulation depth of 500 KHz). In the ENDOR spectrum two peaks are clearly observed. One very strong interaction at $23.8_1$ MHz and a smaller interaction at $14.0_1$ MHz. That these two lines belong indeed to the same interaction is proven by the Triple ENDOR experiment: using the setting T=8K, microwave power of 100 mW, a first radio-frequency (RF power of 100 W) is swept from 10 MHz to 25 MHz and a second (RF power of 100 W) is pumped to 23.8 mhz (the biggest interaction).

As the natural abundance of $^{19}$F is 100% and I=1/2, two lines are expected. Because the superhyperfine interaction is smaller than the nuclear Zeeman interaction the two lines should be centered around the nuclear Zeeman interaction of $^{19}$F (for B=0.4679G the nuclear Zeeman interaction of $^{19}$F is $18.8_1$ Mhz), what is indeed the case. The hyperfine interaction of the $^{19}$F is the splitting between the two lines: $9.8_1$ MHz. (the subscript is the error on the last digit).

From foregoing it could be concluded that the incorporation of fluorine atoms in an $OsCl_6^{2-}$-complex can result in effective trapping centers as shown in the $E_6$-emulsion (for a deep electron trap) and in the $E_{10}$-emulsion (for the formation of a SET).

Example 2

Application of Halogen-fluor-complexes of Platinum as Dopants in Silver Halide Emulsion A reference emulsion was prepared in an identical way as emulsion E2 in the previous example. The emulsion E13 was prepared in an identical way as emulsion E2, except that between seconds 72 and 306 of the precipitation of the silver halide grains 10.06 ml of an aqueous solution containing 1.5 $10^{-4}$ mole/l of $K_2PtF_6$ was added using a separate jet at a constant flow rate. Further emulsion preparation steps were identical to those in example 1. The primitive and the chemical sensitized emulsions were coated on a substrated PET base at 1.85 g gelatin/$m^2$ and 25 mmol AgCl/$m^2$. An emulsion containing gelatin (1.0 g/$m^2$), a divinylsulphonyl-hardener and surfactants was coated on top of the emulsion layer.

Strips with the coated emulsions were image-wise exposed through a step-wedge original using a $10^{-3}$ sec Xenon flash. The exposed photographic materials were developed in a commercial developer G101 for 15 sec. at 35° C. and fixed for 5 minutes in a commercial fixer G333C (Trademark of Agfa) which was 1/3 diluted with demineralized water.

Sensitometric data are summarized in Table 2.1. For all these samples the fog level was 0.03 to 0.05. Sensitivity was measured at a density level of 0.2 above fog and contrast was evaluated between densities 0.1 and 0.5 above fog, i.e. in the foot of the densitometric curve. Definition of sensitometric parameters was identical to those in example 1.

TABLE 2.1

Sensitometric data for the none doped and the $PtF_6^{2-}$ doped emulsions.

| Emulsion N° | Dopant | Chem. Sens. (+/−) | Rel. Sens. (0.2 + Fog) | Rel. Contr. (0.2–0.5) + Fog | |
|---|---|---|---|---|---|
| E2 | none | − | 100 | 100 | Comparat. |
| E13 | $K_2PtF_6$ | − | 74 | 119 | Invention |
| E2 | none | + | 100 | 100 | Comparat. |
| E13 | $K_2PtF_6$ | + | 100 | 103 | Invention |

In the primitive emulsions a limited desensitization and contrast enhancing activity was noticed. In the chemical sensitized emulsions apparently no influence was induced on the photochemical efficiency of the emulsion by the incorporation of the dopant.

Powders were prepared in a similar way as explained for the emulsions in example 1. Similar EPR tests were done on these powders to investigate the electron-trapping activity of the fluorine-platinum complexes. Experimental results are summarized in Table 2.2.

From these experiments it is obvious that the halogen-fluorine-platinum complexes are shallow electron trapping agents in AgCl emulsions.

TABLE 2.2

Experimental EPR data for the non-doped and the $PtF_6^{2-}$-doped emulsions.

| Emulsion N° | Dopant | g-value | line width (mT) | Intensity (a.u.) |
|---|---|---|---|---|
| E2 | none | 1.8787 | 0.962 | 135 |
| E13 | $K_2PtF_6$ | 1.8796 | 1.015 | 215 |

Example 3

Application of Halogen-fluor Complexes of Iridium to Silver Halide Emulsion

Preparation of Emulsions E14 to E18

Emulsion E14

The emulsion E14 was prepared in an identical way as emulsion E2, except that between seconds 72 and 306 of the precipitation of the silver halide grains 10.06 ml of an aqueous solution containing 1.5 $10^{-4}$ mole/l of $K_2IrCl_6$ was added by using a separate jet at a constant flow rate.

Emulsions E15

The emulsion E15 was prepared in an identical way as emulsion E2, except that between seconds 72 and 306 of the precipitation of the silver halide grains 10.06 ml of an aqueous solution containing 1.5 $10^{-4}$ mole/l of $[(CH_3)_4N]_2IrF_3Cl_3$ was added by using a separate jet at a constant flow.

Emulsions E16

The emulsion E16 was prepared in an identical way as emulsion E2, except that between seconds 72 and 306 of the precipitation of the silver halide grains 10.06 ml of an aqueous solution containing 1.5 $10^{-4}$ mole/l of $[(CH_3)_4N]_2IrF_4Cl_2$ was added by using a separate jet at a constant flow.

Emulsions E17

The emulsion E17 was prepared in an identical way as emulsion E2, except that between seconds 72 and 306 of the precipitation of the silver halide grains 10.06 ml of an aqueous solution containing 1.5 $10^{-4}$ mole/l of $[(CH_3)_4N]_2IrF_5Cl$ was added by using a separate jet at a constant flow.

Emulsion E18

The emulsion E18 was prepared in an identical way as emulsion E2, except that between seconds 72 and 306 of the precipitation of the silver halide grains 10.06 ml of an aqueous solution containing 1.5 $10^{-4}$ mole/l of $K_2IrF_6$ was added by using a separate jet at a constant flow rate.

Further emulsion preparation steps were again identical to those explained in example 1.

The primitive and the chemical sensitized emulsions were coated on a substrated PET base at 1.85 g gelatin/$m^2$ and 25 mmol AgCl/$m^2$. An emulsion containing gelatin (1.0 g/$m^2$), a divinylsulphonyl-hardener and surfactants was coated on top of the emulsion layer.

Strips of these coated emulsions were image-wise exposed through a step-wedge original using a $10^{-5}$ sec or a 10 sec Xenon flash with an equal energy dose in both exposures. The exposed photographic materials were developed in a commercial developer G101 for 15 sec. at 35° C. and fixed for 5 minutes in a commercial fixer G333C (Trademark of Agfa) which was 1/3 diluted with demineralized water.

Sensitometric data are summarized in Table 3.1. For all these samples the fog level was 0.03 to 0.05. The relative sensitivity was determined in a similar way as mentioned above and the reference density level was 0.2 above fog.

Depending the ligand structure of the iridate compounds used as dopant in these AgCl emulsions, significant influences on quantum efficiency and reciprocity failure are observed. For these high local dopant concentrations, a desensitization of the $IrCl_6^{2-}$ dopant is observed, in agreement with e.g. the observations of

TABLE 3.1

Sensitometric data for the iridium doped emulsions.

| Emulsion N° | Chem. Sens. (+/−) | Dopant | Rel. Sens. ($10^{-5}$ sec) | Rel. Sens. (10 sec) | |
|---|---|---|---|---|---|
| E2 | − | none | 100 | 100 | Comparat. |
| E14 | − | $K_2IrCl_6$ | 62 | 83 | Comparat. |
| E15 | − | $[(CH_3)_4N]_2IrF_3Cl_3$ | 37 | 76 | Invention |
| E16 | − | $[(CH_3)_4N]_2IrF_4Cl_2$ | 81 | 78 | Invention |
| E17 | − | $[(CH_3)_4N]_2IrF_5Cl$ | 91 | 100 | Invention |
| E18 | − | $K_2IrF_6$ | 110 | 170 | Invention |
| E2 | + | none | 100 | 100 | Comparat. |
| E14 | + | $K_2IrCl_6$ | 83 | 76 | Comparat. |
| E15 | + | $[(CH_3)_4N]_2IrF_3Cl_3$ | 71 | 89 | Invention |
| E16 | + | $[(CH_3)_4N]_2IrF_4Cl_2$ | 87 | 87 | Invention |
| E17 | + | $[(CH_3)_4N]_2IrF_5Cl$ | 81 | 83 | Invention |
| E18 | + | $K_2IrF_6$ | 79 | 95 | Invention |

S. H. Ehrlich et al, J. Imag. Sci. Technol. 36(2), 105, (1992). For a partially F-substituted iridium compound, the desensitization is even larger for the primitive emulsion and equal for the sensitized emulsion, whereas for the further F-substituted compounds the desensitizing effect was lowered in the case of the primitive emulsions and even switched to a sensitizing effect while this influence was not noticed on the chemical sensitized emulsions.

The activity of the dopants in AgCl were again tested by EPR spectroscopy. The procedure followed was identical to the procedure described in the examples above and giving experimental results which are summarized in Table 3.2.

TABLE 3.2

Experimental EPR characteristics for the iridium doped emulsions.

| Emulsion | Dopant | g-value | line-width (mT) | Intensity (a.u.) |
|---|---|---|---|---|
| E2 | none | 1.8787 | 0.962 | 135 |
| E14 | $K_2IrCl_6$ | n.a.°) | n.a.°) | n.a.°) |
| E15 | $[(CH_3)_4N]_2IrF_3Cl_3$ | # | # | # |
| E16 | $[(CH_3)_4N]_2IrF_4Cl_2$ | 1.8793 | 1.045 | 311 |
| E17 | $[(CH_3)_4N]_2IrF_5Cl$ | 1.8786 | 1.32 | 302 |
| E18 | $K_2IrF_6$ | 1.8791 | 1.047 | 351 |

#No significant signal observable at 2K around g = 1.878

°)n.a. = not available.

It is evident from these experiments that the highly F-substituted iridates act as shallow electron trapping dopants incorporated in the AgCl emulsion crystals. The electron trapping properties of the tri-fluoro-tri-chloro-iridates is deeper while no SET signal was observed with EPR spectroscopy. It is consistent with photographic test, showing a signifant desensitizing effect especially at short exposure times.

What is claimed is:

1. A photosensitive image-forming element comprising on a support at least one photosensitive layer containing silver halide crystals that are internally doped with a transition metal complex represented by the general formula (1):

$$[ML_{6-n}F_n]^{m-} \quad (1)$$

wherein:

M represents a metal selected from the group consisting of the metals belonging both to Group 7, 8, 9 and 10 and to the Periods 4, 5 and 6 of the Periodic System of Elements, each L represents a chlorine atom, n equals a value satisfying following equation:

$$1 \leqq n \leqq 6,$$

m equals a value of 1, 2, 3 or 4.

2. A photosensitive image-forming element according to claim 1, wherein in the general formula (1) M represents a metal selected from the group consisting of Ir, Os and Pt.

3. A photosensitive image-forming element according to claim 1, wherein the concentration of the transition metal complex according to formula (1) is between $1\times10^{-10}$ and $1\times10^{-2}$ mole per mole of silver halide.

4. A photosensitive image-forming element according to claim 1, wherein said silver halide crystals contain one or more additional dopants being different from the one represented by formula (1).

5. A photosensitive image-forming element according to claim 1, wherein said silver halide crystals are composed of at least one halide selected from the group consisting of chloride, bromide and iodide.

6. A photosensitive image-forming element according to claim 1, wherein said silver halide crystals have a mean spherical equivalent diameter SED, expressed in $\mu$m, wherein $0.01 \leqq \text{SED} \leqq 1.50$.

7. A photosensitive image-forming element according to claim 1, wherein said element is a photo-addressable thermographic element, comprising a substantially light-insensitive organic silver salt, an organic reducing agent therefor in thermal working relationship therewith and a binder.

8. A method for obtaining a photosensitive image-forming element comprising the steps of:

precipitating silver halide emulsion crystals in the presence of one or more transition metal complex(es) represented by the general formula ( 1):

$$[ML_{6-n}F_n]m^- \quad (1)$$

wherein:

M represents a metal selected from the group consisting of the metals belonging both to Group 7, 8, 9 and 10 and to the Periods 4, 5 and 6 of the Periodic System of Elements, each L represents a chlorine atom, n equals a value satisfying following equation:

$$1 \leqq n \leqq 6,$$

m equals a value of 1, 2, 3 or 4, chemically ripening and/or fogging said crystals while spectrally sensitizing or desensitizing said emulsion, and coating said emulsion on at least one side of a support.

* * * * *